United States Patent [19]

Hinchcliffe et al.

[11] Patent Number: 4,785,831

[45] Date of Patent: Nov. 22, 1988

[54] METHOD AND APPARATUS FOR MINIMIZING LOOSE ENDS IN CIGARETTES

[75] Inventors: Dennis Hinchcliffe, London, England; Francis A. M. Labbe, Neuilly-sur-Seine, France; Desmond W. Molins; Paul R. Wiese, both of London, England

[73] Assignee: Molins PLC, London, England

[21] Appl. No.: 909,234

[22] Filed: Sep. 19, 1986

Related U.S. Application Data

[63] Continuation of Ser. No. 767,341, Aug. 21, 1985, abandoned.

[30] Foreign Application Priority Data

Aug. 22, 1984 [GB] United Kingdom ..... 8421320

[51] Int. Cl.[4] ..... A24C 5/60

[52] U.S. Cl. ..... 131/88; 131/90; 131/79; 131/362

[58] Field of Search ..... 131/79, 88, 81, 90, 131/365, 354, 362

[56] References Cited

U.S. PATENT DOCUMENTS

| | | | |
|---|---|---|---|
| 1,648,655 | 11/1927 | Menzies | 131/88 |
| 2,333,049 | 10/1943 | Shapiro | 131/88 |
| 2,617,426 | 11/1952 | Patterson | 131/88 |
| 3,319,632 | 5/1967 | Burbig | 131/88 |
| 3,402,722 | 9/1968 | Kochalski | 131/88 |
| 3,410,279 | 11/1968 | Moshy et al. | 131/88 |
| 3,485,208 | 12/1969 | Hemming et al. | 131/88 |
| 3,490,462 | 1/1970 | Martin | 131/365 |
| 3,732,872 | 5/1973 | Lakritz | 131/88 |
| 4,186,754 | 2/1980 | Labbe | 131/281 |
| 4,341,228 | 7/1982 | Keritsis et al. | 131/354 |
| 4,409,995 | 10/1983 | Nichols | 131/84.1 |
| 4,619,276 | 10/1986 | Albertson et al. | 131/79 |

FOREIGN PATENT DOCUMENTS

| | | |
|---|---|---|
| 0172654 | 2/1986 | European Pat. Off. . |
| 2160213 | 6/1973 | France . |
| 1357057 | 6/1974 | United Kingdom . |
| 1508616 | 4/1978 | United Kingdom . |
| 2128873 | 4/1986 | United Kingdom . |

*Primary Examiner*—V. Millin

*Attorney, Agent, or Firm*—Antonelli, Terry & Wands

[57] ABSTRACT

Loss of tobacco from the ends of cigarettes is reduced or prevented by applying foamed adhesive thereto. The foam may in general be blown onto the cigarette ends or may be "printed" onto the cigarette ends. The expansion ratio of the foam in preferably at least 10:1, so that very little liquid adhesive is needed to contact a significant area of tobacco. Thus the liquid content of the adhesive may be readily absorbed into the tobacco so as not to create a drying problem. In a preferred example foam is supplied by a pipe to fill apertures on a disc from which measured quantities of foam are blown by an air jet from a pipe. Suction is applied to the filter ends of the cigarettes via a manifold and flexible seals to help in drawing the foam into the cigarettes.

27 Claims, 2 Drawing Sheets

Fig. 4.
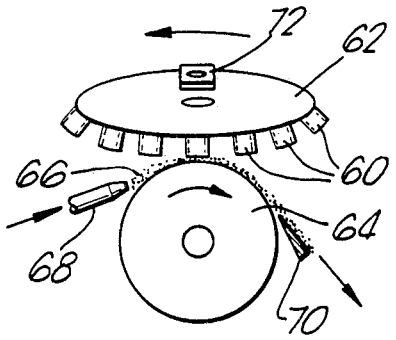
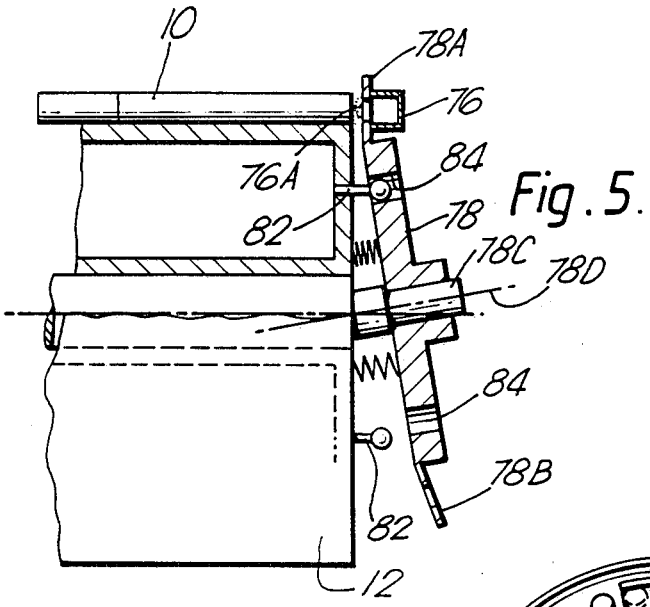
Fig. 5.
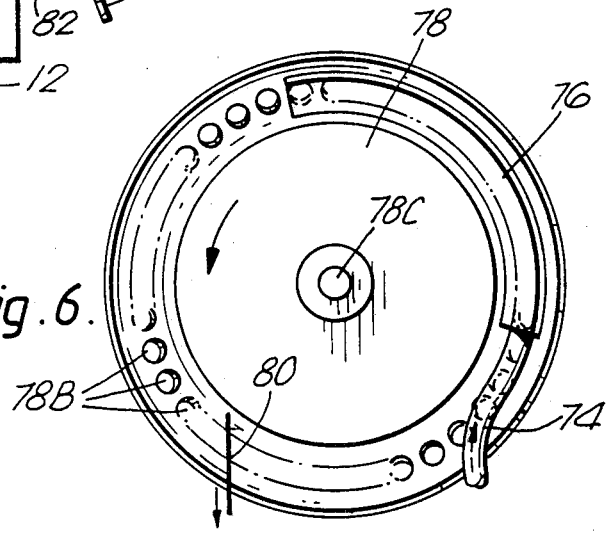
Fig. 6.

METHOD AND APPARATUS FOR MINIMIZING LOOSE ENDS IN CIGARETTES

This is a continuation of application Ser. No. 767,341, filed Aug. 21, 1985, now abandoned.

While cigarettes are being conveyed between making and packing machines, there is a tendency for loose tobacco to fall out of the tobacco ends of the cigarettes. If an excessive amount of tobacco is lost, then the ends of some cigarettes can end up inadequately filled and such cigarettes need to be ejected in the cigarette packing machine as they could otherwise lead to customer complaints. In order to minimise the risk of "loose ends", it is common to arrange for the cigarette making machine to produce a cigarette filler stream with localised additional quantities of tobacco (so-called "dense ends") coinciding with the tobacco ends of the cigarettes, so that the ends are at least initially more dense than the remainder of the cigarettes. That procedure reduces the chances of some cigarettes ending up with loose ends, but it does not eliminate the possibility entirely and it does involve a sacrifice in terms of extra usage of tobacco.

It has previously been proposed to apply additional adhesive to the tabacco at the ends of the cigarettes to prevent or reduce loss of tobacco from the ends. However, no practical application of that principle has evolved.

According to one aspect of the present invention, adhesive is applied to the tobacco ends of cigarettes in the form of a foam. Preferably the foam has an expansion ratio of at least 10:1. In other words, the volume of the foam as a result of the bubbles of air or other gas in the adhesive is 10 times greater than that of the initial liquid adhesive. This allows the foam to contact a significant area of tobacco particles at the end of the cigarette without involving the use of so much liquid that drying of the adhesive becomes a problem. With an expansion ratio of at least 10:1 (and preferably at least 15:1), the amount of liquid involved can readily be absorbed by the tobacco in the cigarette and does not constitute a significant drying problem.

This invention will be described with reference to filter cigarettes which have only one tobacco end. However, it should be appreciated that the invention is also applicable to plain (non-filter) cigarettes and may be applied to both ends of such cigarettes.

The foam may in general be applied in measured quantities to the ends of the cigarettes by blowing or by use of a printing technique. In both cases, suction may be applied to the filter ends of the cigarettes to assist in drawing the foam into the tobacco ends.

Examples of apparatus according to this invention are shown in the accompanying drawings. In these drawings:

FIG. 4 shows a modification of the FIG. 3 apparatus viewed from the right.

FIG. 5 illustrates another arrangement for blowing foam onto the cigarettes; and FIG. 6 is a view from the right of the apparatus shown in FIG. 5.

Figure 1:
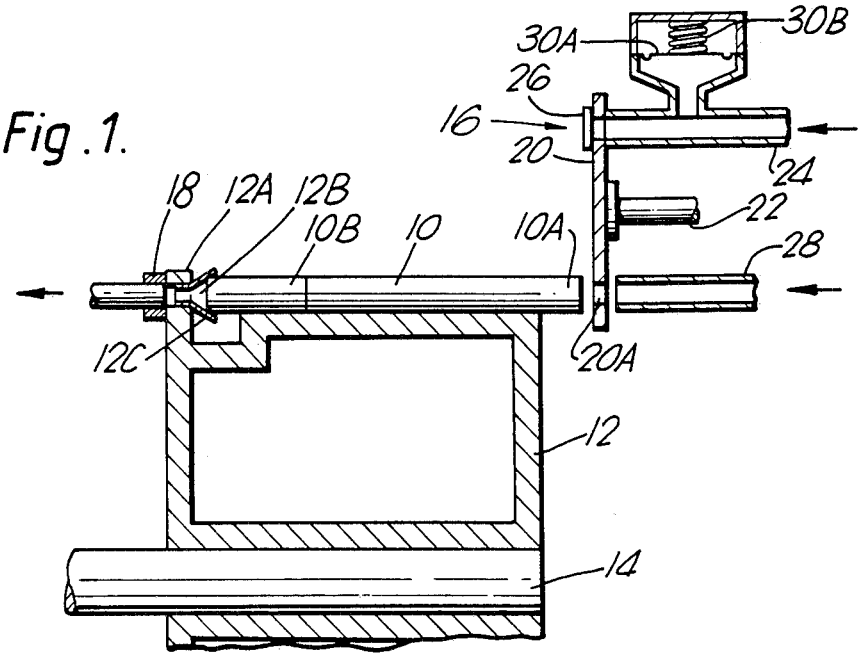
FIG. 1 is a diagrammatic fragmentary view of one apparatus for blowing the foam into the cigarettes.

FIG. 1 shows filter cigarettes 10 being conveyed by a fluted drum 12 mounted on a shaft 14. A measured quantity of foam is applied to the tobacco end 10A of each cigarette by a device 16 while suction is applied to the filter end 10B via a stationary suction pad 18 which bears against a flange 12A of the drum 12. Suction is transmitted to the cigarette through a passage 12B in the flange via a flexible conical seal 12C. In order to make sealing contact with the corresponding seal 12C, each cigarette may be pressed against the seal by a device (not shown) upstream of the foam-applying device 16 by engagement with the tobacco end of the cigarette; alternatively, each cigarette may be sucked onto the seal by suction applied through the manifold 18.

The device for applying measured quantities of foam comprises a disc 20 mounted on a shaft 22 and having circumferentially spaced apertures 20A which register with successive cigarettes 10. Each aperture 20A is filled with foam supplied by a pipe 24 while a stationary closure plate 26 covers the reverse side of the aperture. While each aperture is aligned with one of the cigarettes 10, a pulse of air is applied through a pipe 28 producing an air jet or a group of substantially parallel jets which blow the foam from the aperture 20A onto the adjacent cigarette end.

It is possible for the apertures 20A in the disc 20 to be at the same pitch as the cigarettes on the drum 12. However, that would involve significant intervals during which no foam can flow from the pipe 24 into apertures 20A. During such intervals it is necessary to buffer the flow of foam and for that purpose a bypass arrangement is provided, consisting of a diaphragm or other movable part 30A backed by a spring 30B. The buffer capacity needed for this purpose can be reduced or possibly eliminated if the pitch of the apertures 20A is reduced so that the apertures 20A are almost adjacent to one another. In that case the circumferential speed of the apertures 20A would be correspondingly reduced in comparison with the circumferential speed of the cigarettes.

FIG. 1 for convenience shows foam being supplied to the apertures 20A at a position 180° offset from the air pipe 28. In practice, the foam may be supplied to the apertures 20A immediately upstream of the pipe 28 to minimise the time during which the foam can start to degrade (i.e. return to its liquid form).

Instead of being mounted on the shaft 22, the disc 20 (with an appropriately larger diameter) may be mounted on an extension of the shaft 14, i.e. coaxially with the drum 12. In this case air may blow continuously from the pipe 28, whereas it is preferably pulsed in the case of the arrangement shown in FIG. 1, each pulse coinciding with the arrival of a cigarette and aperture 20A in alignment with the pipe 28.

By way of example, each aperture 20A may have a diameter of 5.0 to 5.5 mm. It is desirable to ensure that the foam does not come into contact with the cigarette wrapper. That can be achieved by making the diameter of the aperture significantly smaller than the cigarette diameter which is typically 8 mm. The thickness of the disc may, for example, be 3 mm.

The internal diameter of the pipe 24 may be the same as, or slightly less than, that of the apetures 20A. Alternatively, the outlet end of the pipe may be in the form of a number of parallel small-diameter nozzles. In the former case the air pressure should be relatively low, for example 0.25 to 0.5 pounds per square inch (1725 to 3450 Pa) to avoid splashing of the cigarette wrapper with adhesive on account of an excessive air flow. In the latter case (with multiple nozzles) a higher air pressure can be used.

In order to minimise friction between the disc 20 and the tube 24 and plate 26, the disc 20 may be made of or coated with a lowfriction plastics material such as ultra-high molecular weight polyethylene.

The adhesive used in the formation of the foam may, for example, be a sodium salt of carboxymethyl cellulose (commonly abbreviated to NaCMC). For example, the adhesive may be used as a 3% solution in water. A small quantity of surfactant, for example 1%, is added as a foaming agent to facilitate foaming.

In one experiment foam was formed from a water-based solution including 3% of a low-viscosity form of carboxymethyl cellulose (identified as Courlose F.8.P by the manufacturer, Courtaulds PLC) plus 1% of a surfactant identified as Perlankrol DSA by its manufacturer, Lankro of Manchester M3O OBH, England. The optimum blow ratio we found to be 16:1, which gave adequate bonding to a depth of about 1.5 mm into the end of the cigarette, while using a small enough quantity of water to allow reasonably quick drying.

In average atmospheric conditions it was found that the adhesive nevertheless took a few minutes to dry sufficiently to fully secure the tobacco in the ends of the cigarettes. In order to reduce the drying time, the adhesive mixture may be heated (e.g. to between 60 and 70 degrees C.) before entering the foaming equipment; heating moreover facilitates the use of a higher blow ratio, which reduces the drying time by reducing the amount of water in a given volume of foam.

Figure 2:
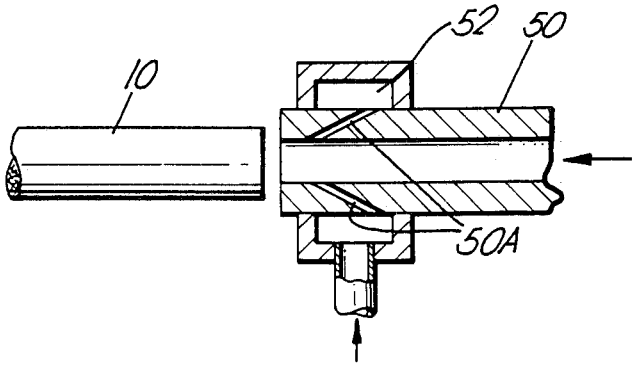
FIG. 2 illustrates diagrammatically an alternative arrangement for blowing foam into the cigarettes.

FIG. 2 shows an alternative arrangement for blowing measured quantities of foam onto cigarettes 10 carried by a drum which may be similar to the drum 12 in FIG. 1 and may include a similar provision for sucking the foam into the cigarettes.

Foam in this case is supplied through a pipe 50 which has, near its outlet end, a number of circumferentially spaced passages 50A inclined so that air blown into those passages from a manifold 52 propels a measured quantity towards the end of the adjacent cigarette Air pressure pulses are supplied to the manifold 52 at a frequency corresponding to the frequency at which cigarettes pass the pipe 50. With this arrangement it is not necessary to include a buffer such as that shown in FIG. 1.

There may be two or more circumferentially spaced pipes 50. Each may supply a part of the total foam required for each cigarette. Alternatively, two pipes 50 may for example be pulsed at half the frequency to supply foam to alternate cigarettes.

As a result of the inclination of the passages 50A in FIG. 2, each blob of foam propelled from the pipe 50 tends to become streamlined (approximately pear-shaped), being stretched in its direction of movement and being slimmed laterally by the action of the converging air jets. This assists the penetration of each blob of foam into the corresponding cigarette while reducing the risk of adhesive coming into contact with the cigarette wrapper.

A similar effect can be achieved in the arrangement shown in FIG. 1, that is by producing a number of converging air jets (or an equivalent annular air jet) in the member 28 to blow successive blobs of foam from the apertures 20A. As in FIG. 2 the point of convergence of the air jets or annula curtain preferably lies substantially at the centre of the leading face of each block before commencement of its propulsion by the air jet or jets, thus imparting the greatest velocity to the leading end of each blob.

Figure 3:
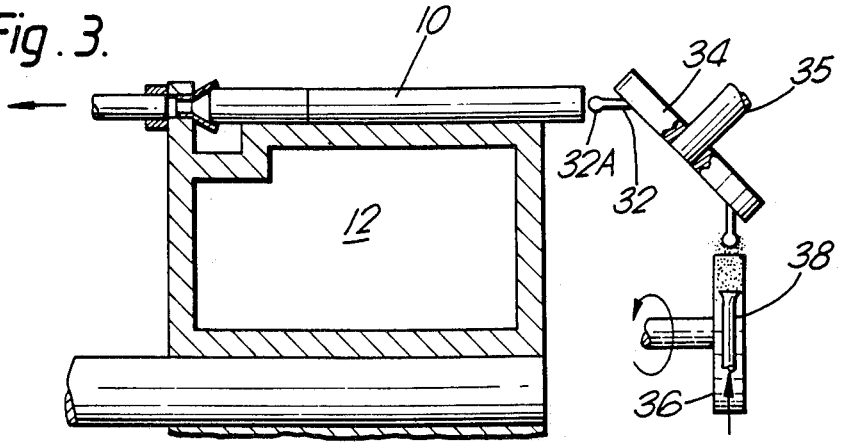
FIG. 3 illustrates diagrammatically an arrangement for printing foam onto the cigarettes.

FIG. 3 shows cigarettes 10 being conveyed by a drum 12 which may be similar to the drum 12 shown in FIG. 1 and may include the same suction provision. Measured quantities of foam are printed onto the cigarette ends by pins 32 mounted at circumferentially spaced positions on a disc 34. Each pin has a spherical end 32A, for example of 6 mm diameter. Foam is picked up from a continuous ribbon of foam formed on a wheel 36 by a nozzle 38.

The disc 34 is carried by a shaft 35 set at 45° to the axis of the drum 12. Consequently, the closest point between each pin 32 and the corresponding cigarette 10 occurs, as shown in FIG. 3, where foam is to be transferred to the cigarette from the pin.

FIG. 4 shows a modification of the apparatus shown in FIG. 3. Each pin 60 on an inclined disc 62 (corresponding to disc 34 in FIG. 3) is set at 45 degrees to the disc 62 and is hollow so that a measured quantity of foam enters the pin as it approaches a wheel 64. A ribbon of foam 66 is formed on the wheel 64 for that purpose by a nozzle 68, and excess foam remaining on the wheel is removed by a scraper 70 for return to the source of adhesive. When each pin 60 comes into alignment with a corresponding cigarette, the foam contained in it is blown out by air supplied via a manifold 72.

FIGS. 5 and 6 show another arrangement in which the foam is printed onto the ends of cigarettes 10 carried by a drum 12. The foam is supplied by a pipe 74 to an arcuate manifold 76 lying in contact with a thin peripheral portion 78A of a disc 78. At regular intervals corresponding to the pitch between cigarettes 10 on the drum 12, there are apertures in the peripheral portion 78A. Foam gently exudes through the apertures and produces beads 76A which project from the left of the disc so as to be applied to corresponding cigarette ends.

The disc 78 rotates about an axis 78D which is inclined to the axis of the drum. Accordingly, each aperture in the peripheral portion 78A of the disc gradually moves closer to the drum to apply the foam adhesive, and then gradually moves away from the drum. Any adhesive left on the disc is scraped off and fed back to the source of the foam by a pair of scrapers 80 engaging opposite faces of the portion 78A of the disc.

The apertures 78B in the disc may be approximately 4 to 5 mm in diameter. Alternatively, each aperture may be replaced by a cluster of smaller apertures, depending upon the foam pressure and on the degree to which the foam spreads on exuding out of the apertures.

Suction may be applied to the filter ends of the cigarettes as described above.

The disc 78 is rotatably mounted on a shaft 78c and is driven by a number of pins 82 extending axially from the end of the drum 12 and engaging in corresponding apertures 84 in the disc 78. Thus the disc 78 rotates at the same speed of the drum 12.

A further possibility is that, instead of being applied as foam, the adhesive may be applied in small measured quantities in liquid form by a device similar to an ink jet printer. Such a device could be used to apply a suitable pattern of adhesive to the end of each cigarette as it moves past, the ends of the cigarettes being arranged to move past the "printer" nozzle, closely spaced therefrom, so that measured quantities of adhesive can be accurately squirted onto each cigaretter end.

We claim:

1. A method of treating cigarettes in which the cigarettes are conveyed sideways past an adhesive applicator whereby a measured quantity of foamed adhesive is applied to the tobacco end of each cigarette by pneumatically transferring a measured quantity of the foamed adhesive from said adhesive applicator toward and onto the tobacco end of each cigarette to secure the tobacco in the cigarette.

2. A method according to claim 1 in which the foam is applied to the tobacco in such a way that no foam reaches the cigarette wrapper.

3. A method according to claim 1 in which the foam is produced from a solution of adhesive and surfactant in water with an expansion ratio of at least 10:1.

4. A method of treating cigarettes in which the cigarettes are conveyed sideways past an adhesive applicator whereby a measured quantity of foamed adhesive is applied to the tobacco end of each cigarette by pneumatically transferring a measured quantity of the foamed adhesive onto the tobacco end of each cigarette to secure the tobacco in the cigarette, the measured quantities of adhesive being produced by filling apertures in a moving disc with foam, and in which the foam in each aperture is pneumatically transferred onto the corresponding cigarette end.

5. A method of treating cigarettes in which the cigarettes are conveyed sideways past an adhesive applicator whereby a measured quantity of foamed adhesive is applied to the tobacco end of each cigarette by pneumatically transferring a measured quantity of the foamed adhesive onto the tobacco end of each cigarette to secure the tobacco in the cigarette, and in which, while foam is being applied to one end of each cigarette, suction is applied to the other end to assist in drawing the foam into the cigarette.

6. Apparatus for treating cigarettes to reduce the loss of tobacco from the ends, comprising a conveyor for conveying cigarettes sideways along a predetermined path, means adjacent to the path for generating individual measured quantities of foamed adhesive, and means for pneumatically transferring a respective measured quantity of the foamed adhesive from said generating means toward the path and onto one end of each cigarette.

7. Apparatus according to claim 6 in which the means for applying foamed adhesive comprises means for feeding individual measured amounts of foamed adhesive successively to a delivery point, and including means for blowing each measured amount in turn onto a cigarette end.

8. Apparatus for treating cigarettes to reduce the loss of tobacco from the ends, comprising a conveyor for conveying cigarettes sideways along a predetermined path, means adjacent to the path for generating individual measured quantities of foamed adhesive, and means for pneumatically transferring a respective measured quantity of the foamed adhesive toward the path and onto one end of each cigarette, said means for generating individual measured quantities of foamed adhesive comprising a rotating disc formed with apertures which are filled with foamed adhesive at a station remote from a station at which the foamed adhesive is pneumatically transferred from the apertures and onto the cigarette ends.

9. Apparatus according to claim 8 in which the apertures are substantially circular in cross-section and have a diameter smaller than that of the cigarettes.

10. Apparatus according to claim 8 in which the foamed adhesive is fed into the apertures in the disc from a fixed source adjacent to the disc.

11. Apparatus according to claim 10 including a fixed plate arranged to close the apertures on one side of the plate while foamed adhesive is being received into the apertures from the other side of the plate.

12. Apparatus for treating cigarettes to reduce the loss of tobacco from the ends, comprising a conveyor for conveying cigarettes sideways along a predetermined path, means adjacent to the path for generating individual measured quantities of foamed adhesive, means for pneumatically transferring a respective measured quantity of the foamed adhesive toward the path and onto one end of each cigarette, and means for applying suction to one end of each cigarette while foamed adhesive is being delivered onto the other end.

13. Apparatus for reducing the loss of tobacco from the ends of cigarettes, comprising means for conveying cigarettes sideways along a predetermined path through a treatment station, means for projecting a measured quantity of adhesive onto the tobacco in the end of each cigarette at the treatment station, and means for applying suction to the other end of each cigarette at the treatment station to promote the entry of the adhesive into the tobacco.

14. Apparatus according to claim 13 in which the adhesive is adapted to be applied in the form of a foam, and including means for forming individual measured quantities of foam and means for blowing said measured quantities onto successive cigarettes at the treatment station.

15. A method of treating cigarettes, comprising the steps of conveying cigarettes sideways through a treatment station, providing a measured quantity of foamed adhesive at the treatment station, and applying the measured quantity of foamed adhesive to the tobacco end of a cigarette at the treatment station by propelling the measured quantity of foamed adhesive pneumatically onto said cigarette end.

16. A method of treating cigarettes in which the cigarettes are conveyed sideways past an adhesive applicator whereby a measured quantity of adhesive is applied to the tobacco end of each cigarette by projecting the adhesive onto the tobacco end to secure the tobacco in the cigarette, and in which a partial vacuum is formed in each cigarette whereby air is drawn into the end of the cigarette to which adhesive is applied.

17. Apparatus for treating cigarettes to reduce the loss of tobacco from the ends, comprising a conveyor for conveying cigarettes sideways along a predetermined path, means adjacent to the path for generating individual measured quantities of adhesive, and means for projecting a respective measured quantity of adhesive from said generating means towards the path and onto one end of each cigarette.

18. A method of introducing measured quantities of foam into the ends of cigarettes, in which the cigarettes are conveyed sideways while measured quantities of foam are applied to respective ends of the cigarettes in a foam transfer area by a moving transfer device which receives the measured quantities of foam at an upstream location prior to arrival in the adhesive transfer area, and in which a partial vacuum is formed in each cigarette for drawing air into the end of the cigarette to which the foam is applied.

19. A method according to claim 18, in which said step of forming a partial vacuum within each cigarette comprises the application of suction pressure to the end of the cigarette remote from the end to which foam is applied.

20. Apparatus for introducing measured quantities of foam into the ends of cigarettes, comprising a conveyor for conveying cigarettes sideways along a first predetermined path, foam transfer means movable along a second path, means at one portion of said second path for applying said measured quantities of foam to said transfer means, each measured portion being transferred in turn to one of the cigarettes at a second portion of said path downstream of the first portion, and including means for forming a partial vacuum within each cigarette for drawing air into the cigarette end to which the foam is applied.

21. Apparatus according to claim 20, in which the means of forming a partial vacuum within each cigarette comprises means for applying suction to the end of the cigarette opposite to the end to which foam is applied.

22. Apparatus for treating the ends of cigarettes, comprising means for conveying cigarette sideways along a predetermined path through a treatment station, means for transferring measured quantities of treatment material onto one end of each cigarette at the treatment station, and means for applying suction to the other end of each cigarette at the treatment station to promote the entry of the treatment material into the cigarette.

23. Apparatus according to claim 22, in which the treatment material is in the form of a foam and the means for transferring foam onto each cigarette comprises an apertured member of which a portion lies close to and moves at the same speed as the cigarettes whereby each aperture is aligned with a cigarette for a predetermined period, and including means for filling the apertures with foam prior to arrival of the apertures at the treatment station at which the foam is transferred from the apertures and onto the corresponding cigarette ends.

24. A method of treating cigarettes in which the cigarettes are conveyed sideways past an adhesive applicator whereby a measured quantity of foamed adhesive is applied to the tobacco end of each cigarette by pneumatically transferring a measured quantity of the foamed adhesive onto the tobacco end of each cigarette to secure the tobacco in the cigarette, said pneumatic transfer being at least aided by the formation of a partial vacuum within each cigarette whereby air is drawn into the end of the cigarette to which foamed adhesive is applied.

25. Apparatus for treating cigarettes to reduce the loss of tobacco from the ends, comprising a conveyor for conveying cigarettes sideways along a predetermined path, means adjacent to the path for generating individual measured quantities of foamed adhesive, and means for pneumatically transferring a respective measured quantity of the foamed adhesive toward the path and onto one end of each cigarette, said means for pneumatically transferring adhesive onto each cigarette being at least partly constituted by means for partially evacuating the interior of each cigarette whereby air is drawn into the end of the cigarette onto whcih foamed adhesive is transferred.

26. A method of treating cigarettes, comprising the steps of conveying cigarettes sideways through a treatment station, providing a measured quantity of foamed adhesive at the treatment station, applying the measured quantity of foamed adhesive to the tobacco end of a cigarette at the treatment station by propelling the measured quantity of foamed adhesive pneumatically onto said cigarette end, and forming a partial vacuum within each cigarette whereby air is drawn into the end of the cigarette to which the foamed adhesive is applied.

27. Apparatus for treating cigarettes to reduce the loss of tobacco from the ends, comprising a conveyor for conveying cigarettes sideways along a predetermined path, means adjacent to the path for generating individual measured quantities of adhesive, means for producing a respective measured quantity of adhesive towards the path and onto one end of each cigarette, and means for producing a partial vacuum within each cigarette whereby air is drawn into the end of the cigarette onto which the adhesive is projected.

* * * * *